US006540190B2

(12) United States Patent
Keshavjee

(10) Patent No.: US 6,540,190 B2
(45) Date of Patent: Apr. 1, 2003

(54) CARPET STANDOFF

(76) Inventor: Sadruddin Keshavjee, 704, 41ST Avenue N.E., Calgary, Alberta (CA), T2E 3P7

( * ) Notice: Subject to any disclaimer, the term of this patent is extended or adjusted under 35 U.S.C. 154(b) by 0 days.

(21) Appl. No.: 09/941,593

(22) Filed: Aug. 30, 2001

(65) Prior Publication Data

US 2003/0042384 A1 Mar. 6, 2003

(51) Int. Cl.[7] ..... B65D 19/00
(52) U.S. Cl. ..... 248/346.11; 248/188.2
(58) Field of Search ..... 248/188.2, 188.3, 248/346.01, 346.05, 346.4, 346.5, 346.11, 188.7; 47/71

(56) References Cited

U.S. PATENT DOCUMENTS 1,925,241 A * 9/1933 Fullerton
2,206,694 A * 7/1940 Greene
2,893,164 A * 7/1959 Martin
3,762,591 A * 10/1973 Gray ..... 215/393
4,073,454 A * 2/1978 Sauber
4,765,360 A * 8/1988 Baird
5,199,676 A * 4/1993 Kowalewski ..... 248/146
5,321,909 A * 6/1994 Loran
5,372,342 A * 12/1994 Adams ..... 248/150
5,395,086 A * 3/1995 Goldstein ..... 248/146
5,419,524 A * 5/1995 Evans et al.
5,743,506 A * 4/1998 Adams
6,012,185 A * 1/2000 Woods et al.

* cited by examiner

*Primary Examiner*—Korie Chan
(74) *Attorney, Agent, or Firm*—Sean W. Goodwin

(57) ABSTRACT

A sturdy and non-marking standoff is inserted between a piece of furniture and a supporting surface and comprises a platform supported by a plurality of radially extending, non-marking vanes. When supporting furniture over wet carpet, the carpet is permitted to dry due to air spaces formed between the vanes and between the carpet and the platform. Preferably, an upstanding rim is added about the perimeter of the platform for cooperating with additional standoffs to enable stacking; the vanes of one standoff being laterally constrained by the rim of an adjacent and lower stackable standoff.

11 Claims, 4 Drawing Sheets

CARPET STANDOFF

FIELD OF THE INVENTION

The present invention relates generally to a carpet standoff which is inserted between furniture and a supporting surface such as carpet. More particularly, one standoff, or multiple stacked standoffs, are inserted to raise furniture above the surface of a wet carpet, thereby allowing the carpet to dry.

BACKGROUND OF THE INVENTION

In the carpet cleaning industry it is quite usual to face the situation of having to move furniture back into a room shortly after the carpet has been cleaned. In such circumstances the carpet is generally still wet, and any furniture that is placed upon it will prevent that portion of carpet directly underneath the furniture's legs, and other contact surfaces, from drying properly. More importantly, the moisture in the carpet can cause the furniture to form wood or rust stains on the carpet. The furniture itself is also susceptible to damage from the moisture in the wet carpet; due to the moisture soaking up into the furniture's legs or into the cloth skirting of the furniture which, if present, often touches the carpet.

The general practice in the carpet cleaning business is to place foil sheets, or Styrofoam (® Dow Chemical Company) or wooden blocks, underneath the furniture legs. Wooden blocks protect the furniture but can still cause staining. The use of non-wood spacers is successful in preventing the wood or rust stains, however it does not allow that portion of the carpet underneath the foil or block to dry as quickly as the rest of the carpet. The quick drying of a carpet after cleaning is important including: to prevent the shrinking or stretching of the carpet, to prevent damage to the carpet backing, and to prevent mildew. Even if a device is placed under the furniture, it may not provide sufficient height to lift the skirting from the carpet.

In U.S. Pat. No. 6,206,424 a foam drying block is described for use as a furniture slide device. Although this device is useful for moving furniture over a floor surface, it suffers from the same disadvantages as mentioned above; precisely because it uses a foam block which prevents the carpet underneath it from drying quickly. Furthermore, stacking of such blocks (in order to lift the furniture a sufficient height) results in the furniture being precariously balanced on top.

A number of devices are known to alleviate an unrelated problem where furniture legs cause permanent depressions to the carpet due to the placing of the furniture upon the pile of the carpet for prolonged periods of time. For example, furniture support devices are shown in U.S. Pat. No. 5,743,506, and U.S. Pat. No. 5,823,492 as well as in French Pat. Nos. 2,062,032 and 2,265,314. The common elements of these devices include:

- supporting the furniture legs on a horizontal platform;
- transferring the weight of the furniture to the underlying subfloor by a plurality of protrusions which extend down through the carpet pile and through the carpet backing; and
- supporting the platform just above the carpet pile to support a piece of furniture and prevent damage to the carpet pile from the crushing forces of the furniture.

While supporting furniture, these devices do not contemplate the problems associated with wet carpet; particularly the need for circulating enough air between the platforms and the wet carpet to allow carpet to dry quickly. This is understandable as these references are designed to address a completely different problem—protecting the pile from crushing and supporting furniture on a more permanent basis. This permanent aspect of these devices is also reflected in the design of their columnar protrusions—which easily puncture through the carpet pile, carpet backing, and any underlying pad to engage the subfloor. These columnar protrusions are also usually quite short. For example, in U.S. Pat. No. 5,823,492, the protrusions are of such height that, once they pass through the carpet pile, backing and underlying pad, the horizontal platform barely touches the top of the pile.

The columnar protrusions of the prior art also tend to cause damage to the carpet backing and underlay; precisely because they puncture through the carpet. For example, in the French Pat. No. 2265314 the protrusions are descriptively referred to as "points taking support on the ground between the interstices of the fitted carpet". With only four such sharp points, as is shown in the preferred embodiment of this French patent, heavy furniture would also cause the protrusions to penetrate most pliable subfloors making subsequent removal quite difficult.

In general, prior art furniture support devices are intended for long term use and therefore are designed so as to avoid crushing carpet pile. As a consequence, the clearance of the horizontal platform to the carpet pile has conventionally been minimize so that the supported furniture does not appear awkward and unstable. Such minimal clearance affects the air flow between the bottom of the platform and the top of the pile; adversely affecting drying. Furthermore, the prior art furniture support devices do not address the issue of moisture soaking up into a furniture's cloth skirting which often extends below the bottom of the furniture's legs.

Ideally, a device designed to support furniture for use after carpet cleaning would be of sufficient height to allow air currents to dry that portion of the wet carpet directly underneath the furniture quickly. Such a device would have a supporting structure which does not penetrate through the carpet backing or underlying pad, would isolate the furniture leg from the carpet, and would raise the leg securely and sufficiently to elevate skirting above the wet carpet pile.

SUMMARY OF THE INVENTION

The standoff of the present invention is temporarily inserted between a piece of furniture and a supporting surface. In one preferred embodiment the furniture rests on standoff comprising a circular planer platform supported by a plurality of radially extending vanes as legs.

In another embodiment, addition of an upstanding rim about the perimeter of a platform will cooperate with other rimmed standoffs to enable stacking; the vanes of one standoff being laterally constrained by the rim of an adjacent and lower stackable standoff.

In the case of wet carpet the vanes have a height sufficient to space the platform above the carpet, and form a plurality of pie-shaped air spaces between the vanes which enable moisture in the carpet beneath the standoff to evaporate and thus dry the carpet. The vanes are strong and do not penetrate the carpet. Preferably the carpet standoff is constructed of a sturdy, unitary, non-marking and mildew resistant material such as recycled plastic. Such a standoff is inexpensive and lightweight. The design of the standoff shape and the arrangement of the protrusions allow the standoff to carry a substantial weight. Ideally, once the carpet has dried, the standoffs are re-used in subsequent jobs by the cleaning service or for repeated use by a furniture owner. However, the simplicity and resulting low cost makes it economically feasible to abandon the standoffs after a carpet cleaning job, leave the furniture, and let the home-owners remove them once the carpet has dried.

DETAILED DESCRIPTION OF THE PREFERRED EMBODIMENTS

Figure 1:
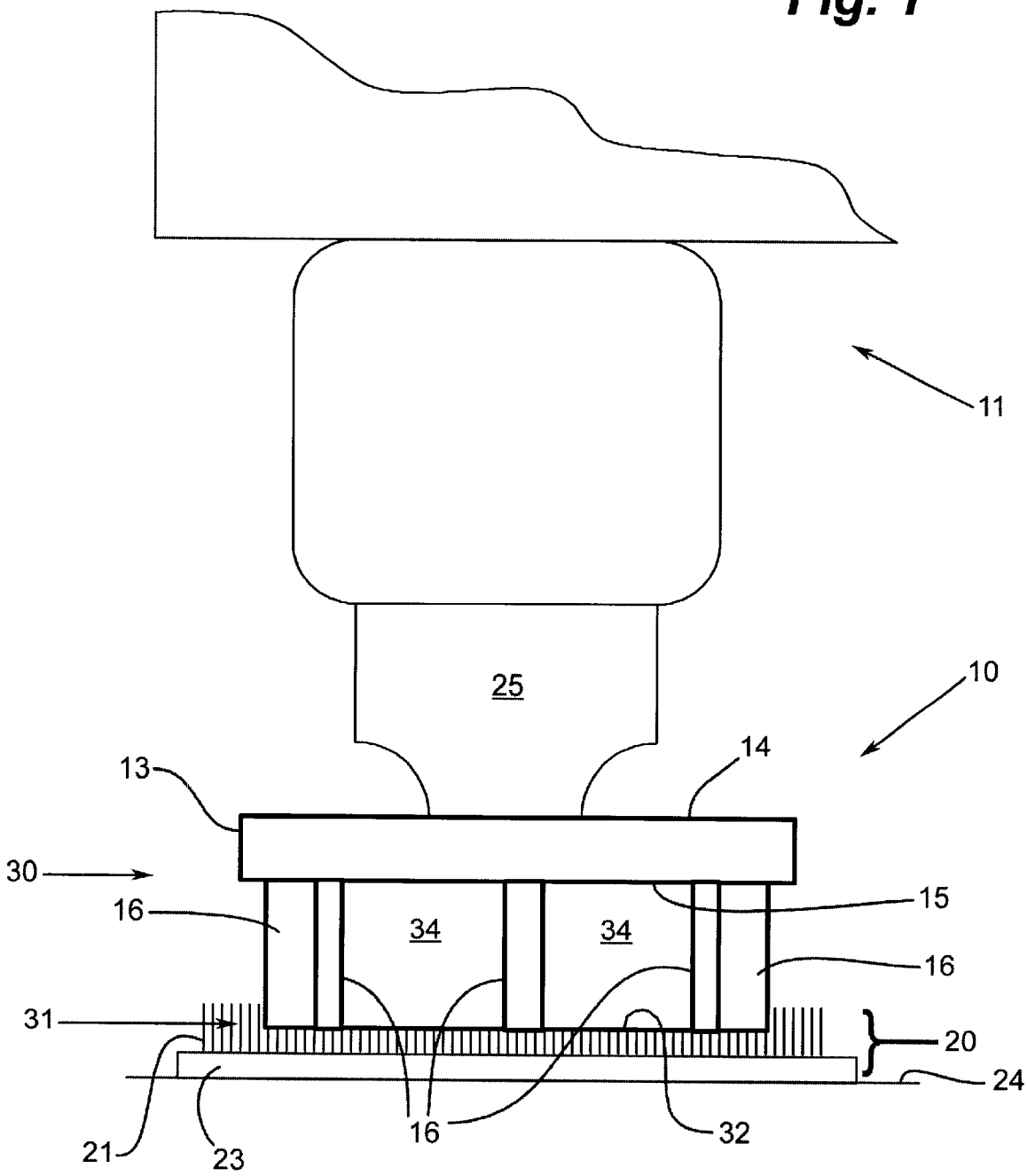
FIG. 1 is a side view of one embodiment of the carpet standoff supported on pile carpet and supporting a furniture leg.

Having reference to FIG. 1, in a first embodiment, a carpet standoff 10 is provided for spacing furniture 11 off of a supporting surface. The standoff 10 comprises a planer platform 13 having an upper, furniture supporting surface 14 and lower surface 15. The platform 13 is illustrated as circular, however, other shapes can be implemented, such as rectangular or polygonal. Protrusions or vanes 16 extend downwardly from the lower surface 15 and act to space the platform 13 from the supporting surface, such as a carpet 20. Carpet 20 conventionally comprises a sheet of grid-like backing material with pile material 21 looped or threaded through the backing and all of which is laid on a carpet pad 23. The carpet pad 23 rests on a supporting surface such as a subfloor 24. After carpet cleaning, the standoff 10 is placed on and supported by the carpet 20. An object, such as the leg 25 of furniture 11 is placed upon and rests on the platform's upper surface 14. Some of the carpet's pile 21 may be bent or displaced as the vanes 16 engage the carpet 20, but this is only temporary until the carpet 20 is dry and the carpet standoff 10 is removed.

Figure 2A:
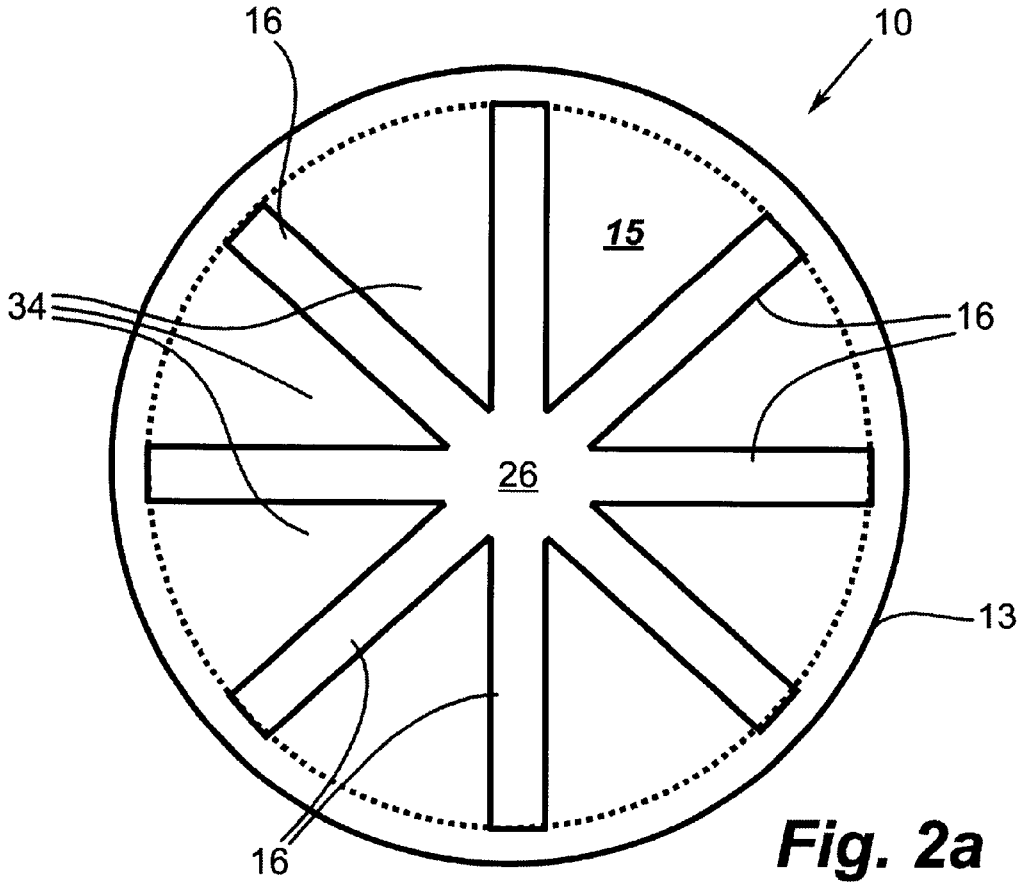
FIG. 2*a* is a bottom view of the embodiment shown in FIG. 1.

As shown in FIGS. 1 and 2*a*, a plurality of radially extending vanes 16 are generally rectangular and are secured to the platform's lower surface 15 along upper linear edges 30. The vanes 16 have lower linear edges 31 which are which parallel to the upper edges 30, and which form a generally planer base 32 for the standoff 10. The rectangular shape of the vanes 16 provide uniform support across the platform's lower surface 15 and distribute the supported load into the carpet 20. The vanes 16 are significantly stronger than prior art columnar protrusions. Preferably, at least the lower edges 31 of the vanes 16, or the entire vanes 16 are constructed of a moisture resistant (including being mildew resistant and non-marking) and structural material. More preferably, the entire standoff is of unitary high density polyethylene (HDPE) plastic construction. In one method of plastic manufacture, such as injection molding, the vanes 16 are slightly tapered from the vane's upper edge 30 the vane's lower edge 31, forming draft so as to allow for easy removal of the carpet standoff 10 from a mold.

As shown in FIG. 2*a*, the vanes 16 can connect or intersect at the center 26 of the lower surface 5, further stabilizing the vanes 16 from buckling or collapsing laterally.

It is understood that only three equi-spaced radial vanes are required to provided stability, however, dependent upon the material characteristics, more may be required. For example, a unitary HDPE plastic standoff having a circular platform diameter of about 38 mm, and a height of about 19 mm would have a load carrying capacity of about 180 Kg/standoff 10 when equipped with eight radial vanes; the vanes and platform each having a thickness of about 1.5 mm. Despite this high load bearing capacity the fact that it is distributed across a large base of radial vanes prevents damage to the carpet backing and underlay from puncturing; which is the case with the furniture support devices of the prior art which use points to distribute the weight of the furniture.

In the case of eight radial vanes 16, eight separate pie-shaped air spaces 34 are formed therebetween. The vanes 16 have a height greater than the height of the pile, typically more than twice the pile height, so that air can circulate into the air space carrying away moisture and drying the carpet 10. Such a standoff 10 can raise the bottom of the furniture 12 mm or more above the carpet's pile 21 and the awkward appearance can serve as a reminder to remove them once the carpet has dried.

Figure 2B:
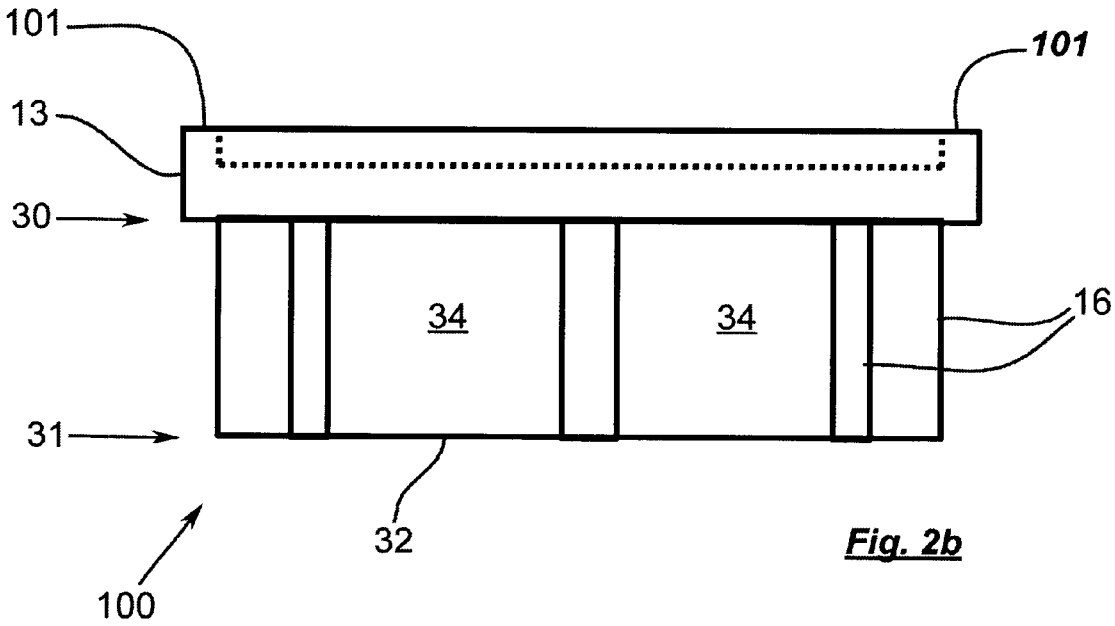
FIG. 2*b* is a side view of another embodiment of the carpet standoff having a rim formed about the platform (illustrated by hidden lines)
Figure 3:
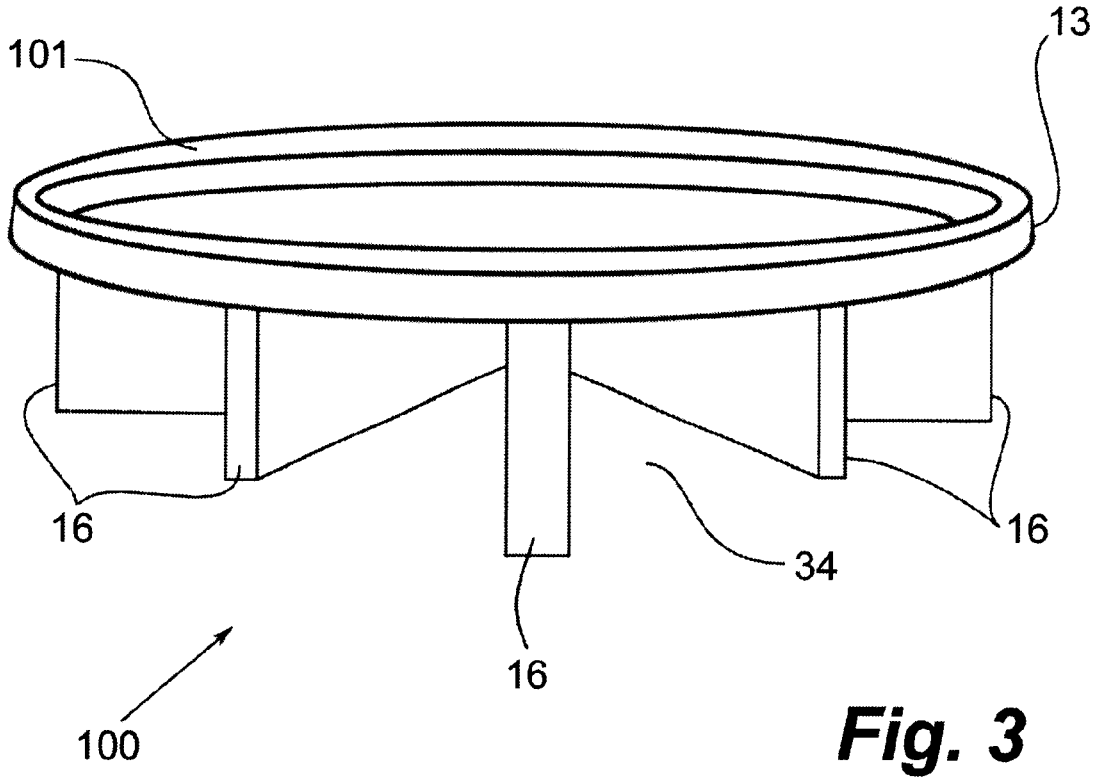
FIG. 3 is an exaggerated perspective view of the embodiment of the carpet-standoff shown in FIG. 2*b*.

Referring to FIGS. 2*b* and 3, in another embodiment, whether used with wet carpet or merely for increasing the height of supported furniture (e.g. to elevate furniture 11 with skirting 102), multiple carpet standoffs 100 are provided which are stackable. A stackable standoff 100 (FIG. 2*a*) comprises a platform 13 and vanes 16 of the standoff 10 of the first embodiment. The platform 13 is additionally formed with at least one rim 101 which projects upwardly from the upper surface 14 and forms an upwardly projecting perimeter around the platform 13 to assist in stacking. The radial extent of the rim 101 corresponds and co-operates with the radial extent of the vanes 16 of another stackable standoff 100. For example, for the HDPE plastic example above for the prior embodiment, with a platform diameter of a 38 mm and a 1.5 mm wide rim located at the periphery of the platform, there is a remaining upper surface 14 diameter of about 35 mm for which to receive the vanes 16 of an other stacked standoff 100.

Figure 4:
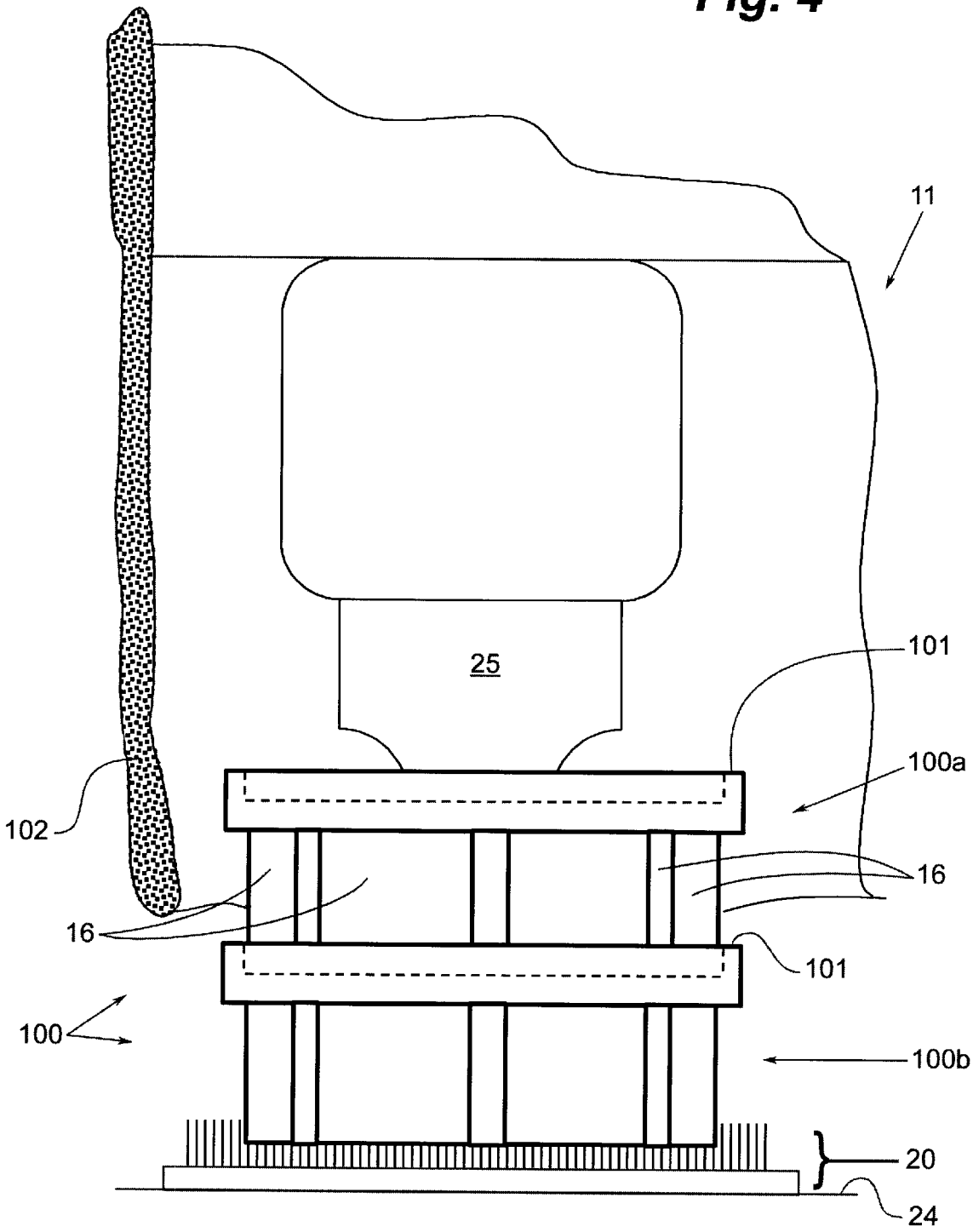
FIG. 4 is a side view of two stacked standoffs of the embodiment from in FIGS. 2*b* and 3 supporting skirted furniture.

Accordingly, as shown in FIG. 4, two stackable standoffs 100 are inserted between a furniture leg 25 and carpet 20; one upper stackable standoff 100*a* being stacked on top of an adjacent lower stackable standoff 100*b*. When stacked, the radial vanes 16 of the upper standoff 100*a* rest on the platform 13 of the lower standoff 100*b* and the vanes 16 of the lower standoff 100*b* rest on the carpet 20.

The upturned rim 101 of the lower stackable standoff 100*b* securely constrains the arrangement of the vanes 16 of the adjacent upper stackable standoff 100*a*, which constrains lateral movement between the individual stackable standoffs 100. By stacking individual stackable standoffs, the furniture 11 that they support can be raised to a sufficient height so as to allow the furniture's skirting 102 to be raised above the wet carpet 20; or raised to even greater heights and thereby creating more clearance underneath the furniture 11,102 which is advantageous when using fans or blowers to speed up the evaporation process. In addition, the stacking feature of individual stackable standoffs 100 can be used in situations other than those involving wet carpet, such as when furniture 11 has to be securely raised above a supporting surface for any number of reasons.

The embodiments of the invention in which an exclusive property or privilege is being claimed are defined as follows:

1. A carpet standoff for insertion between furniture and wet carpet following carpet cleaning comprising:

a platform having an upper surface for supporting the furniture above the wet carpet and a lower surface; and a plurality of radially extending vanes protruding downwardly from the lower surface and having lower edges for engaging the wet carpet, the lower edges being composed of a moisture resistant material, the vanes intersecting with each other at the center of the lower surface and having a height which is sufficient to form a space between the platform and the wet carpet and forming a plurality air spaces between the radial vanes, the platform and the wet carpet so that air can circulate therein and dry the wet carpet beneath the platform.

2. The carpet standoff of claim 1 wherein the platform is circular.

3. The carpet standoff of claim 1 wherein the vanes are constructed of plastic.

4. The carpet standoff of claim 1 wherein the standoff is of unitary construction and constructed of plastic.

5. The carpet standoff of claim 1 further comprising a rim which projects upwardly from the upper surface and forms an perimeter around the platform and wherein the vanes have a radial extent which is less than that of the perimeter so that the vanes of one standoff, when stacked upon the platform of a second standoff, are constrained laterally by the rim of the second standoff.

6. The carpet standoff of claim 5 wherein the platform and perimeter are circular.

7. The carpet standoff of claim 5 wherein the standoff is of unitary construction and is constructed of plastic.

8. A stackable standoff for insertion in multiples between furniture and a wet carpet following carpet cleaning comprising:

a platform having an upper surface for supporting the furniture above the wet carpet and a lower surface, and a rim which projects upwardly from the upper surface for forming an perimeter around the platform; and a plurality of radially extending vanes protruding downwardly from the lower surface and having lower edges being composed of a moisture resistant material, the vanes intersecting with each other at the center of the lower surface and having a radial extent which is less than that of the perimeter so that the vanes of one standoff, when stacked upon the platform of a second standoff, are constrained laterally by the rim of the second standoff, further, the vanes having a height which is sufficient to form a space between the platform and the wet carpet thereby forming a plurality air spaces between the vanes, the platform, and the wet carpet, so that air can circulate therein and dry the wet carpet beneath the platform.

9. The stackable standoff of claim 8 wherein the platform is circular.

10. The stackable standoff of claim 8 wherein the vanes are constructed of plastic.

11. The stackable standoff of claim 8 wherein the standoff is of unitary construction and is constructed of plastic.

* * * * *